US012408716B2

(12) United States Patent
Wagner

(10) Patent No.: US 12,408,716 B2
(45) Date of Patent: Sep. 9, 2025

(54) PAIR OF TROUSERS COMPRISING A WAISTBAND SYSTEM

(71) Applicant: UNI&FORMA d.o.o., Komenda (SI)

(72) Inventor: Armin Wagner, Vodice (SI)

(73) Assignee: UNI & FORMA d.o.o., Komenda (SI)

( * ) Notice: Subject to any disclaimer, the term of this patent is extended or adjusted under 35 U.S.C. 154(b) by 0 days.

(21) Appl. No.: 18/460,502

(22) Filed: Sep. 1, 2023

(65) Prior Publication Data

US 2024/0341383 A1 Oct. 17, 2024

(30) Foreign Application Priority Data

Apr. 12, 2023 (EP) ..... 23167640

(51) Int. Cl.
*A41F 9/02* (2006.01)

(52) U.S. Cl.
CPC ..... *A41F 9/025* (2013.01)

(58) Field of Classification Search
CPC ..... A41F 9/02; A41F 9/025
See application file for complete search history.

(56) References Cited

U.S. PATENT DOCUMENTS 1,959,486 A * 5/1934 Meiklejohn ..... A41F 9/025 2/237
2,590,616 A * 3/1952 Heller ..... A41F 9/02 2/237
4,578,824 A * 4/1986 Waldron ..... A41F 9/025 2/919
4,583,478 A * 4/1986 Bassetti ..... A41F 1/00 2/221
4,642,855 A * 2/1987 Densmore ..... A44B 11/2584 24/310
5,351,340 A 10/1994 Aldridge
6,978,484 B2 * 12/2005 Donlan ..... A41D 1/06 2/247
2005/0177920 A1 * 8/2005 Wilkinson ..... A41D 13/0537 2/69
2005/0223462 A1 10/2005 Snedeker et al.
(Continued)

FOREIGN PATENT DOCUMENTS

DE 102020118561 A1 * 1/2022 ..... A41D 1/06
FR 827812 A * 5/1938
(Continued)

*Primary Examiner* — Megan E Lynch
(74) *Attorney, Agent, or Firm* — Studebaker Brackett PLLC

(57) ABSTRACT

The invention relates to trousers (H) comprising a waistband system (1) with a circumferential waistband (10) and an inelastic closable strap (140) which is integrated into the waistband (10) as an inelastic waistband section (11*a*, 11*b*) at least on a rear side (RS) of the trousers (H), the waistband (10) having at least one waistband section (15) which is monoelastic at least in the longitudinal direction (HR) and can be bridged by means of the strap (140) running parallel thereto, characterized in that the strap (140) comprises two strap parts (141*a*, 141*b*) which can be uncoupled from the trousers (H) in each case at a coupling point associated to the respective strap part (141*a*, 141*b*) and which can be coupled to the inelastic waistband section (11*a*, 11*b*). The invention further relates to a method for producing such trousers (H).

18 Claims, 4 Drawing Sheets

(56) References Cited

U.S. PATENT DOCUMENTS

Figure 1:
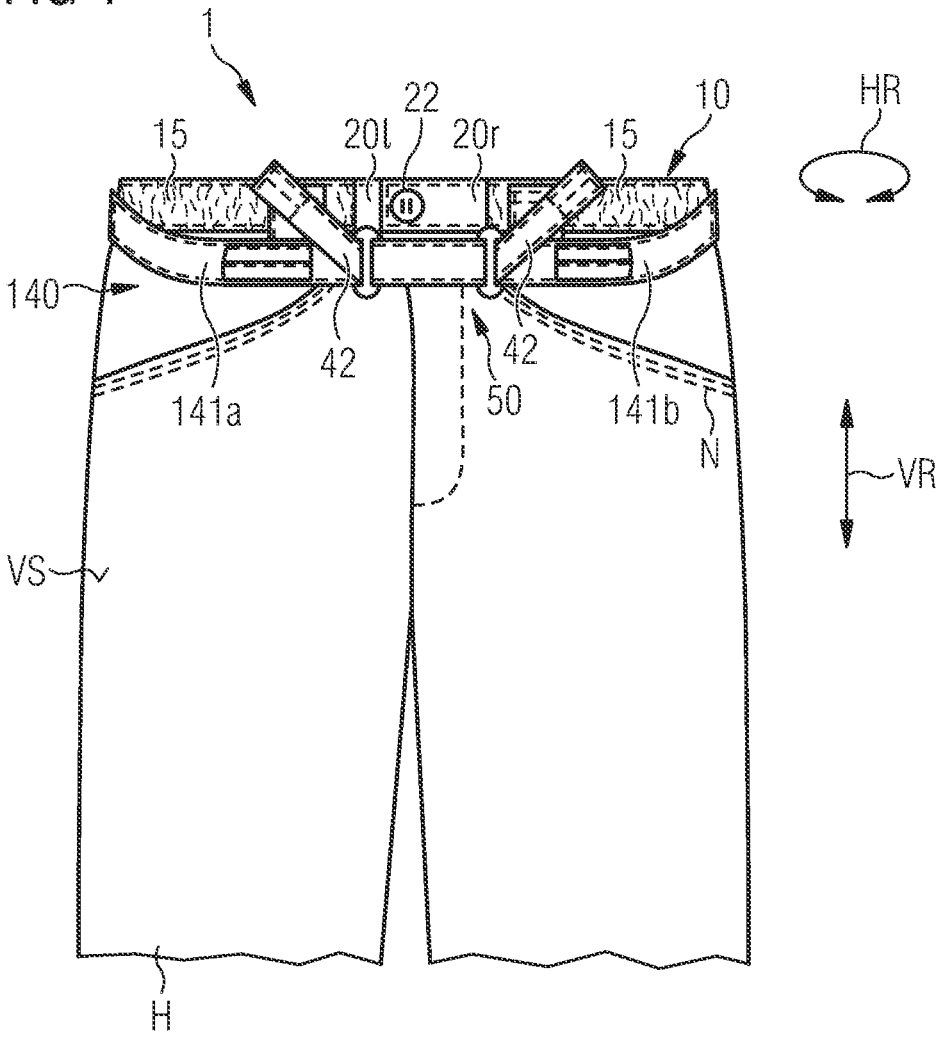

| | | | | |
|---|---|---|---|---|
| 2012/0012630 | A1* | 1/2012 | Lui | A41F 9/002 224/660 |
| 2015/0272249 | A1 | 10/2015 | Glenn | |
| 2017/0000249 | A1* | 1/2017 | Beck | A41F 9/002 |
| 2023/0051747 | A1* | 2/2023 | Morgan | A43C 11/002 |
| 2023/0240401 | A1* | 8/2023 | Wagner | A41D 1/06 223/95 |

FOREIGN PATENT DOCUMENTS

| | | | | | |
|---|---|---|---|---|---|
| FR | 1470422 | A | * | 2/1967 | |
| GB | 410617 | A | * | 5/1934 | |
| GB | 454 838 | A | | 10/1936 | |
| WO | WO-2004060087 | A1 | * | 7/2004 | A41F 9/02 |
| WO | 2022/012906 | A1 | | 1/2022 | |

* cited by examiner

PAIR OF TROUSERS COMPRISING A WAISTBAND SYSTEM

The invention relates to a pair of trousers and a method for producing a pair of trousers. Such trousers are known from WO 2022/012906 A1.

As already explained therein, trousers, shorts, jeans and the like are hip-hugging garments that are used in everyday life to cover the lower part of the body and, if necessary, the legs down to the feet, with trouser legs. They rest with a trouser waistband or waistband on the hips or waist of a wearer. The waistband is usually designed for a certain hip size (which in turn corresponds to a certain clothing size). A longitudinally monoelastic waistband section in the waistband has been found to be particularly advantageous as it ensures a comfortable fit of the trousers and adjusts the waistband to a certain extent to temporary variations in hip circumference. An inelastic fastenable or closable strap, which is integrated into the waistband at least on a rear side of the trousers as an inelastic waistband section as a fixed component of the trousers, ensures that the trousers remain securely on the hip of the wearer even in, for example, special external circumstances, wetness or perspiration, and/or in special, in particular tactical, use, for example, in the fire department, technical emergency services, police, military and the like, in which such clothing often also serves to carry several deployment-related objects or payload, e.g. in trouser pockets or additional holsters (i.e. additional weight).

In practice, however, it has been shown that wearers would also like to wear such particularly comfortable trousers in normal everyday life, e.g. between missions or in their leisure time. However, since the focus of the design so far has not been on creating an all-round trouser for every situation, the known construction still has certain disadvantages, namely a certain lack of flexibility and slight losses in wearing comfort if the wearer decides to wear an additional waist belt or belt over the strap.

It is therefore an object of the present invention to further improve the aforesaid trousers and, in particular, to make them more flexible.

This object is achieved by trousers according to claim 1 and a method for producing the trousers according to claim 10.

Like the trousers mentioned initially, the trousers according to the invention comprise a waistband system with a circumferential waistband and an inelastic closable or fastenable strap which is integrated into the waistband as an inelastic waistband section at least on a rear side of the trousers. In this case, the waistband has at least one waistband section which is monoelastic at least in the longitudinal direction, which can be bridged by means of the strap running parallel thereto.

According to the invention, the strap comprises two strap parts that can be uncoupled from the trousers at a coupling point associated with the respective strap part. The strap parts can be coupled and uncoupled at the coupling points to the non-elastic waistband section, which forms part of the strap. Uncouplable or couplable means that the strap parts can be removed from the trousers and reattached to the trousers.

Preferably, the coupling can take place in a pulling direction, in particular in an insertion direction, which will be explained further below, and the uncoupling in an opposite pulling direction.

A method according to the invention for producing trousers according to the invention with a waistband system comprises at least the following steps:

As in the method mentioned initially, first—as is usual for trousers—the outer fabric cut parts, lining and inserts of a pair of trousers are cut from the corresponding fabrics or provided ready-cut. Then the waistband system of the trousers is provided with a circumferential waistband and a non-elastic or an inelastic closable strap.

In this case, at least one waistband section that is monoelastic at least in the longitudinal direction is incorporated into the waistband, preferably under pre-tension (as will be explained below), which is bridged by means of the strap running parallel thereto. In this case, the closable strap is integrated or sewn into the waistband as an inelastic waistband section at least on a rear side of the trousers.

According to the invention, the strap comprises two strap parts that can be uncoupled or removed from the trousers (at a coupling point associated with the respective strap part), which strap parts are coupled to the inelastic waistband section at the back of the trousers, so that the at least one waistband section that is monoelastic at least in the longitudinal direction is bridged by means of the strap parts of the strap that run parallel thereto in the coupled state.

A strap according to the invention for such trousers comprises at least two strap parts, which each have a coupling means at one end, by means of which they can be coupled to and uncoupled from the trousers at a coupling point of the trousers associated with the respective strap part.

The design according to the invention thus provides a genuine all-round trouser that can be worn in everyday life or in leisure time at home as well as in the office or for special missions, e.g. for the fire brigade, technical emergency services, police, military and the like, as it can be very easily and quickly converted to fit for these purposes.

Further, particularly advantageous embodiments and further embodiments of the invention result from the dependent claims as well as the following description, wherein the independent claims of one claim category can also be further developed analogously to the dependent claims and exemplary embodiments of another claim category and, in particular, individual features of different exemplary embodiments or variants can also be combined to form new embodiments or variants.

Preferably, the inelastic waistband section and the strap sections may comprise interlocking coupling means.

Preferably, at least one coupling means can be plate-shaped, i.e. flat or planar or two-dimensional That is, one side length of one side is dimensioned to be considerably smaller than the other two.

Preferably, the plate-shaped coupling means may have, in a direction perpendicular to its plate-shaped extension, i.e. along the side just mentioned, a side length or thickness of at most 3 mm, particularly preferably at most 2 mm, further preferably at most 1.5 mm, quite particularly preferably at most 1 mm.

Preferably, the strap parts can each comprise a barb-shaped, preferably mushroom-shaped, coupling means and the non-elastic waistband section comprises two slit-shaped coupling means. This means that the inelastic waistband section has, for example, one slot-shaped coupling means at each end, i.e. two slot-shaped coupling means in total.

A flat or plate-shaped coupling means with a mushroom-shaped contour, i.e. with a mushroom-shaped contour or base, is particularly preferred. In other words, a flat or plate-shaped coupling means with a largely "T"-shaped or "arrow"-shaped" profile. The "mushroom" shape per se is therefore not absolutely mandatory, but it does make insertion somewhat easier.

Preferably, the non-elastic waistband section can each comprise an insertion slot or insertion slit into which the coupling means of the strap parts can each be inserted or threaded for coupling in an insertion direction. In the simplest case, the insertion slot can be formed by a suitably modified belt or strap loop with a narrow loop opening adapted to the dimensions of the respective coupling means.

As one variant, the insertion slot of the non-elastic waistband section can be formed in such a way that the coupling means of the strap parts can each be threaded for coupling in the insertion direction from an inner side of the trousers and guided onto an outer side of the trousers, i.e. from the inside to the outside.

In an inserted or threaded state, the strap parts can preferably hook in or remain stuck at a stop point with a stop edge in the direction of insertion. In this position they are then secured against further threading and usually remain there due to a certain material friction or a slight resistance of the strap part stitched onto the coupling means even without permanent tensile stress.

Preferably, the coupling means of the strap parts (especially in the case of a T-shaped or mushroom-shaped design with the T-crossbar) can hook in or stop at a stop seam of the insertion slot (to be explained later).

The slot opening of the insertion slot can preferably be adapted to the coupling means or its internal dimensions can be selected in such a way that the coupling means can be inserted or passed through comfortably, but does not slip out again directly on its own.

In principle, the insertion slot could also be configured as an insertion pocket, i.e. open on one side. This means that the strap parts with their respective coupling means are each inserted into the insertion pocket from an insertion direction and are then hooked therein and, for the finished coupling with the trousers, are then pulled back again slightly against the direction in which they were inserted, so that they then strike the stop seam with their barb-shaped outer form (e.g. of the T-crossbar). For a secure hold on the one hand and a user-friendly coupling or uncoupling on the other hand, the coupling means can, for example, be elastically bendable or foldable perpendicular to the direction of insertion (or to the flat side of the plate-shaped element), so that they can be slightly pressed together or folded together for coupling and uncoupling and, after being pressed together, bend elastically back into their original shape.

Preferably, the coupling means of the strap parts can comprise a flexible plastic material, preferably elastomer, for this purpose.

Preferably, the non-elastic waistband section can substantially, i.e. largely, cover the sacrum of the wearer when the trousers are worn as intended by the wearer. Here, "substantially or largely cover" means that the sacrum of the vast majority of wearers wearing such trousers is covered to a predominant extent.

Alternatively or additionally, the insertion slots can be spaced apart from each other at the coupling points on the back of the trousers. Particularly preferably, they lie symmetrically to a crotch line or symmetry line of the trousers (which runs upward in extension of a crotch seam at the back to the waistband).

Particularly preferably, they can each be arranged eccentrically on the back or rear side of the trousers along the running direction of the waistband.

Further preferably, the insertion slots may be arranged on the waistband of the trousers to the side of the sacrum of a wearer when the trousers are worn as intended.

For example, the insertion slots can also form a passage from the inside of the trousers to the outside of the trousers through which the coupling means can be threaded from the inside of the trousers through the waistband into the matching position on the outside of the trousers.

Preferably, the insertion slot can have at least one stop seam which is worked into the insertion slot perpendicular to the insertion direction as a slot opening constriction and forms a constricted, i.e. laterally limited, insertion tunnel with the remaining insertion slot.

Preferably, the insertion slot may have two such stop seams which together delimit between them (above and below) an insertion tunnel, i.e. a slot opening.

Preferably, a maximum transverse dimension (transverse to the longitudinal direction of the strap parts) of the coupling means of the strap parts perpendicular to the insertion direction can be at least 0.5 mm narrower than the insertion slot itself, more precisely than the slot opening or the insertion tunnel of the insertion slot.

Particularly preferably, a maximum transverse dimension of the coupling means of the strap parts perpendicular to the insertion direction can be at most 1.5 mm narrower than the insertion tunnel of the insertion slot.

As mentioned, the trousers comprise a waistband system having an encircling waistband and an inelastic closable strap integrated into the waistband as an inelastic waistband section at least on a rear side of the trousers.

Preferably, the strap may include fastening means, such as Velcro strips, press studs or the like, for closure. These can be arranged in such a way that the strap can be fastened to itself, e.g. by folding it back or over.

Alternatively, the two parts of the strap can be connected by means of a buckle or other connecting elements that can be opened and closed.

In this case, the waistband has at least one waistband section which is monoelastic at least in the longitudinal direction and can be bridged by means of the strap running parallel thereto.

Such a construction or a producing method of trousers in which, as described above, a waistband system is provided with a circumferential waistband and an inelastic closable strap which is integrated into the waistband at least on a rear side of the trousers as an inelastic waistband section, and in this case the waistband has at least one waistband section which is monoelastic at least in the longitudinal direction, which can be bridged by means of the strap running parallel thereto, can in principle be advantageous for all trousers with a waistband and a strap, irrespective of how precisely the strap itself is divided and/or how the strap can be coupled to the inelastic waistband section of the trousers integrated into the waistband.

Preferably, at least one stiffening strip, preferably running essentially in the longitudinal direction of the strap or strap parts, is incorporated or integrated into the strap, especially preferably into two strap parts of the strap. The stiffening strip helps to thread the coupling means of the strap parts into the respective insertion slot, as the strap is thereby stiffened.

Preferably, the strap or the strap parts can be designed with pockets for this purpose, in which the stiffening strips are accommodated, e.g. sewn in. The pockets can preferably be configured to run longitudinally so that the stiffening strips can provide stiffening in the longitudinal direction of the strap parts.

There are further preferred possibilities for the design, in particular the shape and spatial extension, of the stiffening strip. For example, it can fill a part or even almost the entire strap width. In addition, it can extend so far forward, i.e. into a front waistband area, that various means of deployment, such as holsters for items of deployment such as gloves, tools, weapons, handcuffs, etc., can be suspended or attached to the strap over the length of the strap. However, several stiffening strips can also be incorporated into the strap parts, each of which fills only part of the strap width. For example, two stiffening strips, each occupying half the width of the strap and arranged parallel to each other in abutting fashion, may be incorporated in the longitudinal chambers or pockets to allow easier passage or insertion of the desired coupling means of the strap parts into the insertion slot. For more comfortable wearing, the strap parts can alternatively or additionally be padded or upholstered in the area of the stiffening strips by means of a light 3D knitted fabric.

There are various possibilities for selecting a suitable material for the coupling means of the strap parts for coupling to the strap.

As mentioned, the coupling means of the strap parts can be made of flexible plastics, preferably elastomers. The elastomers are organic polymers with rubber-elastic properties at room temperatures. They can be cut out of the plastic, punched or cast. In the case of the cast variant, it should be noted that the material used is also flexible.

However, the coupling means can also simply be punched or cut out of an appropriately thick plastic or plastic film and either used raw or covered with textile material.

Preferably, an insertion loop can be stitched onto the side of the waistband next to a back pad (which can be sewn into the waistband, e.g. as in WO 2022/012906 A1), into which the strap parts are inserted in each case coming from the back pad in the direction of the trouser front or front of the trousers.

Figure 2:
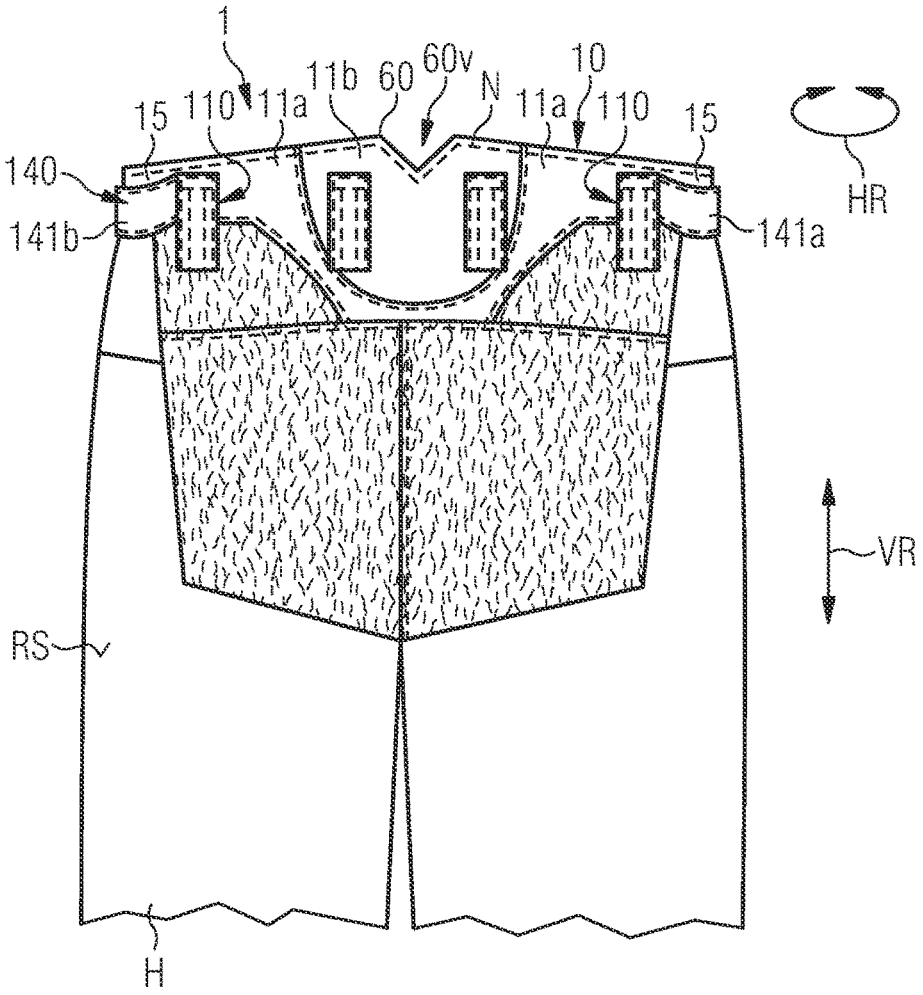
Figure 3:
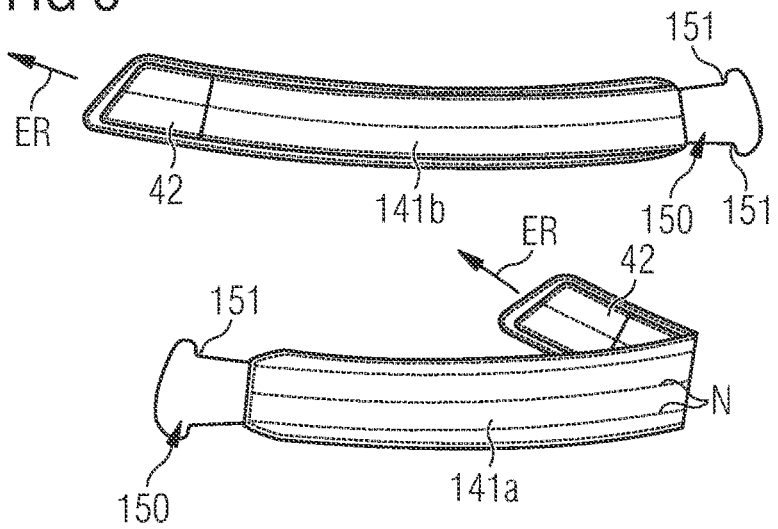
Figure 4:
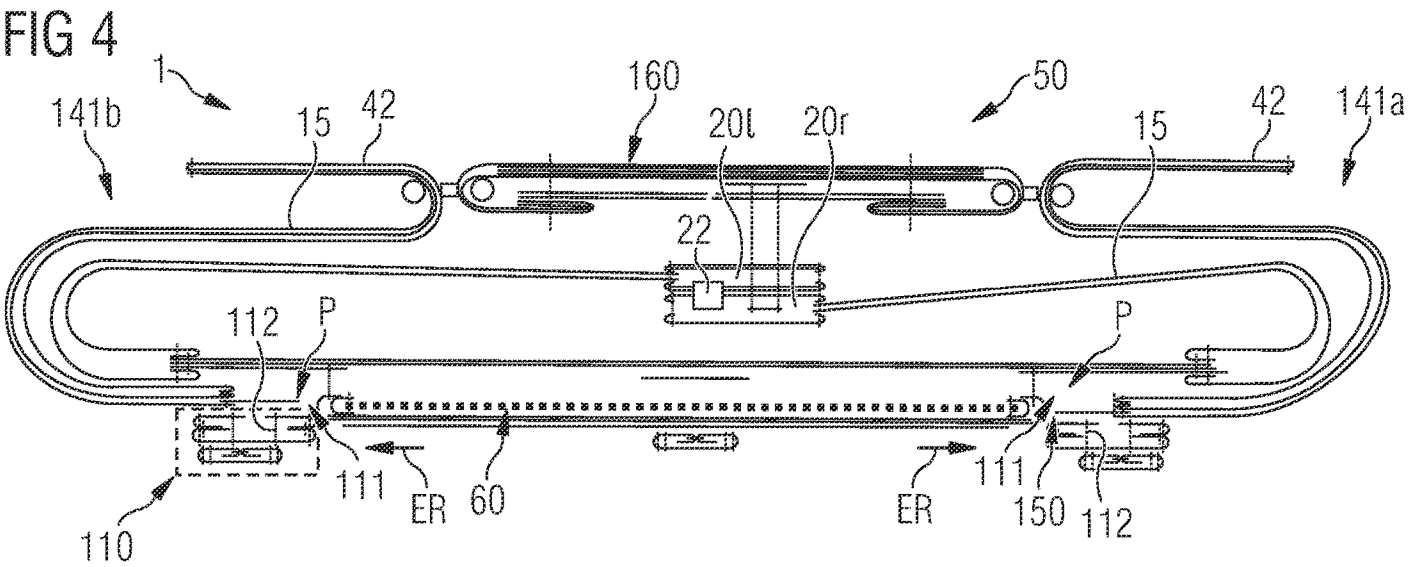
Figure 5:
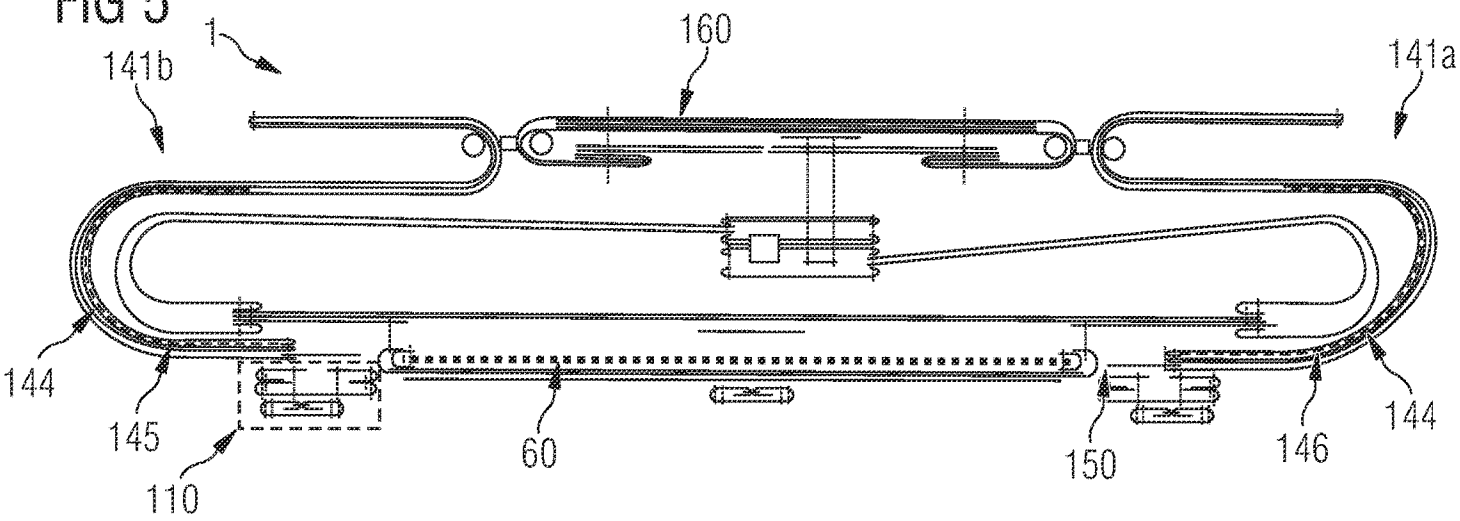
Figure 6:
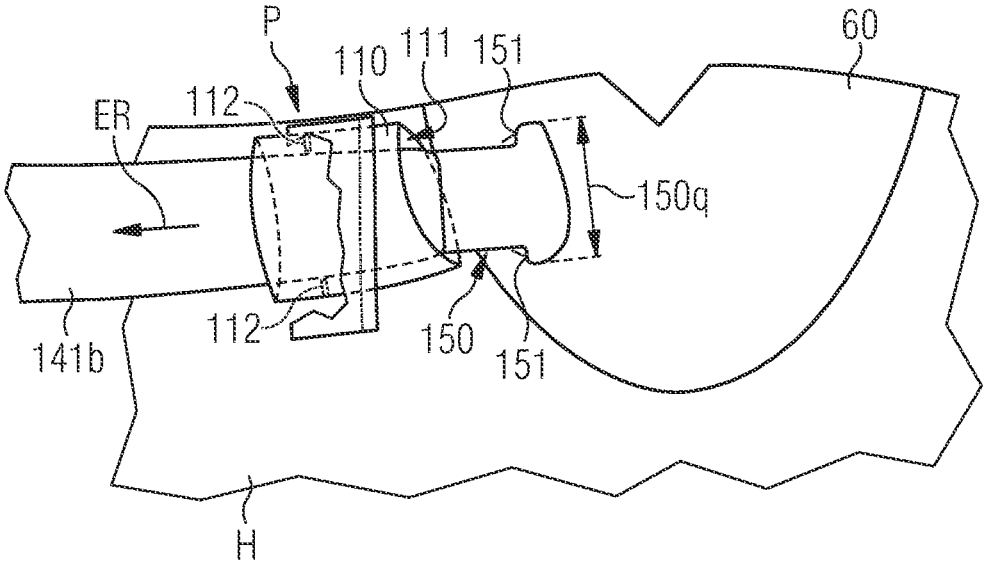
Figure 7:
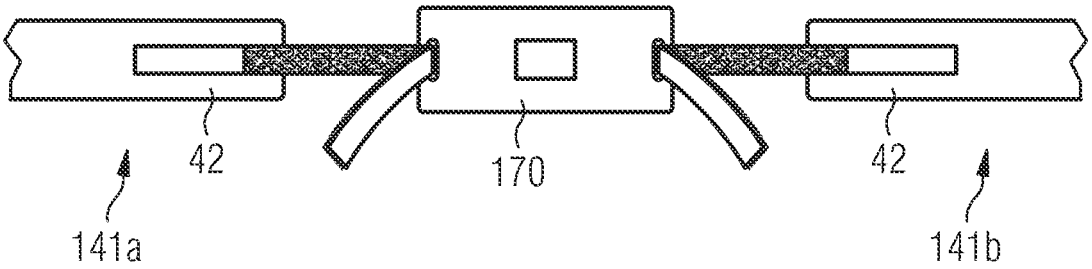

The invention is explained in more detail hereinafter with reference to the attached figures by means of exemplary embodiments. In the various figures, identical components are given identical reference numbers. The figures are generally not to scale. They show:

FIG. 1 a perspective front view of an exemplary embodiment of a pair of trousers according to the invention (upper part shown) with a waistband system according to the invention, with a threaded, partially applied, two-part strap, FIG. 2 a perspective rear view of the upper part of the trousers from FIG. 1, FIG. 3 a perspective rear view of the two parts of the strap from FIG. 1, in a state separated from the trousers, FIG. 4 a schematic top view of a horizontal section through the trousers of FIG. 1, at the level of the waistband, FIG. 5 another schematic top view of a horizontal section through trousers according to FIG. 1, but this time in a reinforced version, FIG. 6 a perspective rear view of a cut-out of the back of the trousers according to FIG. 2, when threading one of the strap parts into an insertion slot on the waistband of the trousers, FIG. 7 a perspective view of a section of the strap parts of the strap to illustrate an alternative variant of fastening the strap parts together, in this case by means of a buckle.

FIG. 1 shows the trousers H according to the invention with a waistband system 1 in a slightly perspective front view of a front side VS of an upper part of the trousers H. In this front view, the trousers 1 do not differ from a precursor of the trousers 1 from WO 2022/012906 A1.

FIG. 2 shows the same trousers H in a rear view of the back side RS of the upper part of the trousers H.

In this respect, reference is made at this point to WO 2022/012906 A1 for the basic structure of the trousers H, in particular to the exemplary embodiment described therein. In order to clarify the differences and relevant improvements in comparison to the already known exemplary embodiment, the already known basic structure will be outlined again in the following and the improvements and innovations will be dealt with in greater detail. In principle, the new trousers H can be constructed very similarly to the trousers described therein, except for the additional improvements which are explicitly explained with reference to FIGS. 3 to 5. As already in WO 2022/012906 A1, the lower part of the trousers H downward of the knees in a distal direction VR or vertical direction VR again plays no significant role for the waistband system 1 according to the invention and is therefore also not shown here in any of the figures.

As can be seen in the slightly perspective front view of a front side VS of an upper part of the trousers H according to FIG. 1 and in the perspective rear view of a rear side RS of the trousers H according to FIG. 2, the waistband system 1 of the trousers H according to the invention comprises, in addition to a circumferential waistband 10, a slightly curved or ergonomically running, closable strap 140, which runs at least in sections parallel, externally around the waistband 10 and with which the waistband 10 can be fixed, adjusted or tightened in the manner of a "belt". Furthermore, on a rear side RS of the trousers H in the region of the waistband 10, the waistband system 1 comprises a back pad 60 on the inside. This has already been described in WO 2022/012906 A1 and again contributes to the special wearing comfort of the trousers H. At this point, it should be mentioned that in the perspective views, all visible seams N, e.g. belt loop seams N, trouser pocket seams N, back pad seams N, etc. are generally shown as dashed lines.

Said waistband 10 is altogether subdivided along its waistband running direction HR, i.e. a horizontal longitudinal direction of the waistband 10, into a plurality of waistband sections 11*a*, 11*b*, 15, 20*l*, 20*r*, which is particularly well illustrated by the schematic top view of the horizontal section through the waistband system 1 according to FIG. 4.

On the rear side RS of the trousers H shown in FIG. 2, an inelastic waistband section 11*a*, 11*b* begins, here additionally widened in an arc and additionally running around the inside back pad 60 at the bottom, which unites the waistband 10 and the strap 40 in sections (on the rear side RS of the trousers H) into one part. Said waistband section 11*a*, 11*b* thereby runs from the rear side RS to the sides of the trousers H, being widest slightly outside the center (along the upper edge of the waistband 10 perpendicular to the waistband running direction HR at the beginning and end of a V-cutout 60*v* of the back pad 60) of the rear side RS of the trousers H. Said strap 140 is therefore a part of the waistband there (on the rear side RS of the trousers H), i.e. integrated into the waistband 10.

Elastic waistband sections 15 adjoin the inelastic waistband sections 11*a*, 11*b*. Two further inelastic waistband end sections 20*l*, 20*r* adjoin these at the ends and can be detachably coupled to one another (at the front end) on the front side VS of the trousers H, as can be seen in particular in FIG. 1.

For closing the entire circumferential waistband 10 or these inelastic waistband end sections 20*l*, 20*r*, respectively, these comprise interlocking fastening means 22. The fastening means 22 are here simply formed as interlocking Velcro surfaces. Equally however, other fastening means 22 are also conceivable, such as buttons, hooks and eyes, etc.

In contrast to the exemplary embodiment of the strap from WO 2022/012906 A1, the strap 140 of the trousers H according to the invention comprises two separate strap parts 141*a*, 141*b*, which here form strap main sections that can be flexibly coupled to the rear waistband section 11*a*, 11*b*. In the state when the trousers H are put on as intended, the said strap parts 141*a*, 141*b* are coupled to the inelastic waistband section 11*a*, 11*b* of the trousers H and thus to the part of the strap 140 integrated in the waistband 10, so that the strap 140 can then be fastened, adjusted or tightened around the waistband 10 in the manner of a "belt" when worn in the donned state or coupled to the trousers H. The two strap parts 141*a*, 141*b* then extend from the inelastic waistband section 11*a*, 11*b* integrated into the back of the waistband 10 parallel to the aforesaid inner elastic waistband sections 15 into a front area of the trousers H and run around the front of the latter.

The strap parts 141*a*, 141*b* of the strap 140 each otherwise comprise a strap end section 42, each forming an end border which can be fixed against itself or against a central part 50. The strap end sections 42 are each located centrally on the front side VS of the trousers H and are guided here through a central part 50 and outward again, as can be seen in FIGS. 1, 4 and 5.

All in all, this ensures that the trousers H fit snugly on the hips of a wearer, in particular even during special operations with a particular load on the waistband and/or at special temperatures and/or under special external conditions.

As can be seen from FIGS. 3, 4 and 6, the strap parts 141*a*, 141*b* can be coupled in the waistband system 1 without tools and can also be uncoupled from it again without tools. For this purpose, the strap parts 141*a*, 141*b* comprise coupling means 150, each formed here as a flat or plate-shaped, almost flat barb-shaped injection-molded part made of plastic. In order that the coupling means 150 does not become uncomfortably bulky, i.e. so that a thickening occurs locally along the running direction of the waistband HR, which could then very quickly cause a pressure point on the hip of the wearer of the trousers H, the coupling means is very flat. This means that the plate-shaped coupling means 150 can preferably be at most 3 mm thin, particularly preferably at most 2 mm thin, further preferably at most 1.5 mm thin and very particularly preferably at most 1 mm thin.

Corresponding to this, the waistband 10 at the outer lateral end of the inelastic waistband section 11*a*, 11*b* has respective slit-shaped coupling means 110 symmetrically to an imaginary central crotch line or line of symmetry of the trousers 1 (which, as mentioned, runs upward in extension of a rear crotch seam to the waistband), which here are formed as insertion slots 110 with an insertion tunnel 111, as can be seen particularly well in FIG. 6. In order to couple the strap parts 141*a*, 141*b* to the inelastic waistband section 11*a*, 11*b*, these are guided or threaded in an insertion direction ER (with their strap end sections 42 first) from the center of the waistband 10 on the rear side RS of the trousers H, i.e. from the direction of the back pad 60, in a sideways direction along the waistband running direction VR through the insertion tunnels 111 of the insertion slots 110 and then pulled out of the insertion tunnel 111 to the front, in each case laterally around the waistband 10, or more precisely the elastic waistband sections 15 of the waistband 10 on the front side VS of the trousers H, until a stop edge 151 of the coupling means 150 stops at a respective stop point P within the insertion slots 110 (see FIG. 6). It should be noted at this point that the insertion slots can, for example, also be formed with an insertion tunnel in such a way that the coupling means of the strap parts can be threaded from an inner side of the trousers through the insertion tunnel in the waistband onto an outer side of the trousers, where the strap parts then strike against once again in the same position at a respective stop point within the insertion slots.

On the front side VS of the trousers H, the strap parts 141*a*, 141*b* can be connected to form a closed strap 140 so that they bridge the elastic waistband 10 of the waistband system 1 on the outside and tighten it in a supporting manner with their non-elastic or inelastic material. For this purpose, as mentioned, the two strap end sections 42 of the strap parts 141*a*, 141*b* are passed through two loops of a central part 50 centrally in front of the inner fly of the waistband 10 of the trousers H and are then fixed against themselves again to the outside or to the side. As already described in WO 2022/012906 A1, the strap end sections 42 may have corresponding interlocking or cooperating hook-and-loop surfaces in sections for this purpose, so that the strap end sections 42 adhere to themselves with certain sections.

At the two aforementioned stop points P, the insertion tunnels 111 of the insertion slots 110 are narrowed from above and below by two stop seams 112 in FIG. 4 and FIG. 6 (shown in dashed lines). The distance between them is at least somewhat smaller than a transverse dimension 150*q* of the coupling means 150 of the strap parts 141*a*, 141*b*, so that the stop edges 151 of the barb-shaped coupling means 150 strike against or hang on them accordingly and cannot be pulled further forward through the insertion tunnel 111. This intended wearing position of the strap parts 141*a*, 141*b* in the waistband system 1 of the trousers H is shown in FIG. 4.

FIG. 5 shows another modified version of the strap parts 141*a*, 141*b*, in which the strap parts 141*a*, 141*b* are provided with inner pockets or pockets 144, in which flexible stiffening strips 145 running along the strap parts 141*a*, 141*b* are inserted and sewn in. The stiffening strips 145 can completely fill the strap 140 or the strap parts 141*a*, 141*b*. Furthermore, they can extend into a front area of the trousers H in order to be able to attach or holster various deployment means or additional equipment almost along the entire strap parts 141*a*, 141*b*. This reinforced variant also allows more weight to be attached to the strap parts 141*a*, 141*b* without them twisting or curling. For example, the weight, e.g. in the form of objects such as a weapon, possibly with weapon holder, gloves, helmet, etc., can be attached to the strap parts 141*a*, 141*b* directly or indirectly, e.g. by means of a holster or the like.

As can also be seen in FIG. 5, a flexible stiffening strip 160 can also be incorporated or integrated into the central section 50 on the front side VS of the trousers H, e.g. again in a pocket provided for this purpose.

In order to improve the wearing comfort, a knitted fabric can be incorporated on the inside or waistband side of the stiffening strips 145, 160 as a soft, somewhat flexible intermediate layer. Specifically, a layer of a 3D knitted fabric 146 (see in particular FIG. 5) can be integrated or worked into the pockets 144 on an inner side of the pocket, i.e. on a side of the stiffening strips 145 facing the body.

FIG. 7 shows an alternative variant of fastening the strap 140 on the front side VS of the trousers H by means of a simple arbitrary buckle 170 instead of a central part 50. For this purpose, the strap end sections 42 are indirectly coupled to one another by passing each through a loop or opening of the buckle 170 and folding over and securing the strap end sections 42 in the region of the Velcro surfaces on themselves, so that the two strap parts 141*a*, 141*b* of the strap 140 and thus the waistband 10 can be tightened in this way. The buckle 170 shown here is only an example of a possible buckle shape. Of course, buckles of other shapes, such as a quick-release buckle, buckles with a magnetic fastener, plastic or synthetic buckles and others are also conceivable.

Compared to the prior art, the construction according to the invention offers the wearer of the trousers several advantages overall: on the one hand, the wearer himself can decide at any time whether he wants to wear the strap according to the invention with the two strap parts and different buckle versions or whether he wants to replace it, for example, with a simple belt, a combat belt or even a conventional underbelt. On the other hand, the design according to the invention reduces the number of layers of material required for the connection between the waistband and the strap at the inelastic waistband section. This reduces a potential cause of pressure points that can occur when wearing additional equipment and fixing it around the waist or hips.

Finally, it is pointed out once again that the devices described in detail above are merely exemplary embodiments which can be modified by the person skilled in the art in a wide variety of ways without leaving the scope of the invention. For example, the invention is not limited to a particular type of trousers, such as long trousers, short trousers or shorts, trouser suits, etc., or to a single intended use, but can be used with any type of trousers, even a jumpsuit with an incorporated waistband and belt and for any occasion. However, it is particularly advantageous for action forces, e.g. police, military, special forces, etc., who need such tactical clothing for special outdoor missions, routine outdoor missions as well as for the normal "office routine" in the coordination center, as this is where its flexibility can be really used. Furthermore, the use of the indefinite articles "one" or "one" does not exclude the possibility that the features in question may also be present more than once. Similarly, the terms "element" and "arrangement" do not exclude that the component in question consists of several interacting subcomponents, which may also be spatially distributed.

REFERENCE LIST

1 Waistband system
10 Waistband
11*a*, 11*b* Waistband section
15 Waistband sections
20*l*, 20*r* Waistband end sections
22 Fastener
41 Strap main sections
42 Strap end sections
50 Central part
60 Back pad
60*v* V-cutout
140 Strap
141*a*, 141*b* Strap parts
110 Coupling means, slot-shaped/insertion slot
111 Insertion tunnel
112 Stop seam of insertion slot
144 Pockets
145 Stiffening strips
146 3D knitted fabrics
150 Coupling means of strap parts
151 Stop edge of insertion slot
150*q* Transverse dimension of the coupling means of the strap parts
160 Stiffening strips
170 Buckle
ER Insertion direction
H Trousers
HR Waistband direction/longitudinal direction of the waistband
N Seams/strap loop seams/trouser pocket seams/back pad seams
P Stop point
VS Front side of the trousers
RS Back/rear side of the trousers
VR Distal direction/vertical direction of the trousers

The invention claimed is:

1. A pair of trousers comprising a waistband system, the waistband system comprising:

a circumferential waistband having an inelastic waistband section on a rear side of the pair of trousers, and at least one elastic waistband section which is monoelastic at least in the longitudinal direction, and two inelastic closable straps which are connectible to the circumferential waistband at least on the rear side of the pair of trousers at the inelastic waistband section, wherein the at least one elastic waistband section is disposed such that it is bridged by means of the straps running parallel thereto, wherein the straps are each connectible to and disengagable from the pair of trousers at a coupling point of the pair of trousers associated with the respective strap and which is coupled to the inelastic waistband section, and wherein the straps each extend parallel to the elastic waistband section continuously from the associated coupling point of the inelastic waistband section to a front area of the trousers, and are indirectly coupled to each other as a belt around the circumferential waistband.

2. The pair of trousers according to claim 1, wherein the inelastic waistband section and the straps comprise positively interlocking coupling means.

3. The pair of trousers according to claim 2, wherein at least one of the coupling means is configured to be plate-shaped.

4. The pair of trousers according to claim 1, wherein the straps each comprise a T-shaped or arrow-shaped coupling means and the inelastic waistband section comprises two slot-shaped coupling means.

5. The pair of trousers according to claim 2, wherein the inelastic waistband section comprises an insertion slot at each of the coupling points, respectively, into which the coupling means of a respective one of the straps is insertable for coupling in an insertion direction and, in an inserted state, hook in at a stop point with a stop edge in the insertion direction at a stop seam of the insertion slot.

6. The pair of trousers according to claim 5, wherein the inelastic waistband section substantially covers the sacrum of the wearer when the pair of trousers are worn as intended by the wearer and/or wherein the insertion slots on the rear side of the pair of trousers are spaced apart from one another, each of the insertion slots being arranged eccentrically on the rear side of the pair of trousers along the waistband.

7. The pair of trousers according to claim 5, wherein the insertion slot has at least one stop seam which is arranged perpendicularly to the insertion direction and forms a narrowed insertion tunnel with the remaining insertion slot.

8. The pair of trousers according to claim 7, wherein a maximum transverse dimension of the coupling means of the straps perpendicular to the insertion direction is at least 1 mm narrower than the insertion slot.

9. The pair of trousers according to claim 2, wherein the coupling means of the straps comprise a flexible plastic material.

10. The pair of trousers according to claim 1, wherein at least one stiffening strip, extending substantially in the longitudinal direction of the straps, is incorporated into the two straps.

11. The straps for the pair of trousers according to claim 1, wherein each of the two straps has a coupling means at one end, by means of which they are connectible to and disengagable from the pair of trousers at the coupling point associated with the respective strap.

12. A method for producing a pair of trousers, the method comprising providing the pair of trousers with a waistband system comprising a circumferential waistband having an inelastic waistband section on a rear side of the pair of trousers, and at least one elastic waistband section which is monoelastic at least in the longitudinal direction, and two inelastic closable straps which are connectible to the circumferential waistband at least on a rear side of the pair of trousers at the inelastic waistband section, wherein the at least one elastic waistband section is bridged by means of the straps running parallel thereto, wherein each of the straps is connectible to and disengagable from the pair of trousers at a coupling point of the pair of trousers associated with the respective strap and which is coupled to the inelastic waistband section, and wherein the straps each extend parallel to the elastic waistband section continuously from the associated coupling point of the inelastic waistband section to a front area of the trousers, and are indirectly coupled to each other as a belt around the circumferential waistband.

13. The pair of trousers according to claim 6, wherein the insertion slots are arranged on the waistband to the side of the sacrum of a wearer when the pair of trousers are worn.

14. The pair of trousers according to claim 7, wherein the insertion slot comprises two such stop seams which together define the insertion tunnel between them.

15. The pair of trousers according to claim 8, wherein a maximum transverse dimension of the coupling means of the straps perpendicular to the insertion direction is at most 1.5 mm narrower than the insertion tunnel of the insertion slot.

16. The pair of trousers according to claim 10, wherein the straps have longitudinally running pockets in which the stiffening strips are received.

17. A pair of trousers comprising a waistband system, the waistband system comprising a circumferential waistband having an inelastic waistband section on a rear side of the pair of trousers, and at least one elastic waistband section which is monoelastic at least in the longitudinal direction, the circumferential waistband being connectible to two inelastic closable straps at least on the rear side of the pair of trousers at the inelastic waistband section, wherein the at least one elastic waistband section is disposed such that it is bridged by means of the straps running parallel thereto, wherein the pair of trousers further comprises two coupling points coupled to the inelastic waistband section, and each of the straps is connectible to and disengagable from the pair of trousers at one of the coupling points associated with the respective strap, and wherein the straps each extend parallel to the elastic waistband section continuously from the associated coupling point of the inelastic waistband section to a front area of the trousers, and are indirectly coupled to each other as a belt around the circumferential waistband.

18. An inelastic closable strap assembly for a pair of trousers, the trousers having a circumferential waistband with an inelastic waistband section on a rear side of the pair of trousers and at least one elastic waistband section which is monoelastic at least in the longitudinal direction, the strap assembly comprising:

two inelastic straps, each of which is connectible to and disengagable from the pair of trousers at a coupling point of the inelastic waistband section associated with a respective one of the straps;

wherein the two straps each comprise a T-shaped or arrow-shaped coupling means for engaging the inelastic waistband section at two corresponding slot-shaped coupling means of the inelastic waistband section;

wherein the strap assembly is for bridging the at least one elastic waistband section by running parallel thereto; and wherein the straps each extend parallel to the elastic waistband section continuously from the associated coupling point of the inelastic waistband section to a front area of the trousers, and are configured to be indirectly coupled to each other as a belt around the circumferential waistband.

* * * * *